US008196514B2

(12) United States Patent
Gustafsson et al.

(10) Patent No.: US 8,196,514 B2
(45) Date of Patent: Jun. 12, 2012

(54) WARHEAD

(75) Inventors: Lennart Gustafsson, Karlskoga (SE); Torsten Rönn, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 697 days.

(21) Appl. No.: 10/597,144

(22) PCT Filed: Jan. 14, 2005

(86) PCT No.: PCT/SE2005/000031

§ 371 (c)(1), (2), (4) Date: Jul. 15, 2008

(87) PCT Pub. No.: WO2005/068930

PCT Pub. Date: Jul. 28, 2005

(65) Prior Publication Data

US 2008/0307994 A1 Dec. 18, 2008

(30) Foreign Application Priority Data

Jan. 15, 2004 (SE) ..... 0400069

(51) Int. Cl.
*F42B 12/62* (2006.01)

(52) U.S. Cl. ..... 102/489

(58) Field of Classification Search ..... 102/489, 102/492, 494, 497, 475

See application file for complete search history.

(56) References Cited

U.S. PATENT DOCUMENTS

| | | | | | |
|---|---|---|---|---|---|
| 2,944,763 | A * | 7/1960 | Grandgent et al. | ..... | 244/3.14 |
| 3,464,356 | A * | 9/1969 | Salzman et al. | ..... | 102/489 |
| 3,565,009 | A * | 2/1971 | Allred et al. | ..... | 102/475 |
| 3,980,019 | A | 9/1976 | Anderson et al. | | |
| 4,245,560 | A * | 1/1981 | Rambauske | ..... | 102/213 |
| 4,638,737 | A * | 1/1987 | McIngvale | ..... | 102/489 |
| 4,655,139 | A * | 4/1987 | Wilhelm | ..... | 102/494 |
| 5,229,542 | A * | 7/1993 | Bryan et al. | ..... | 102/491 |
| 6,598,534 | B2 * | 7/2003 | Lloyd et al. | ..... | 102/494 |
| 6,931,994 | B2 * | 8/2005 | Lloyd | ..... | 102/489 |

FOREIGN PATENT DOCUMENTS

| | | |
|---|---|---|
| DE | 4029898 | 3/1992 |
| DE | 4026813 | 9/1996 |
| EP | 0255214 | 2/1988 |

* cited by examiner

*Primary Examiner* — Bret Hayes
*Assistant Examiner* — Reginald Tillman, Jr.
(74) *Attorney, Agent, or Firm* — Venable LLP; Eric J. Franklin

(57) ABSTRACT

The invention relates to a warhead comprising a first and a second part, the parts being arranged relative to one another along a longitudinal axis, the first part comprising a first explosive section, a casing, and a plurality of projectiles enclosed in the casing. The second part comprises an element designed to control the working of the warhead as a function of a control signal. The fact that the functioning of the warhead can be controlled means that the warhead can defeat a plurality of different targets, which makes the warhead versatile.

24 Claims, 7 Drawing Sheets

WARHEAD

TECHNICAL FIELD

The invention relates to a warhead.

The invention also relates to a missile which comprises the warhead.

The invention also relates to a system in which the warhead is used.

BACKGROUND ART

U.S. Pat. No. 4,638,737 describes an anti-armor missile designed to defeat an active armor placed on a target, such as a tank.

The missile is designed to first defeat the active armor on the tank by means of a cluster of projectiles before allowing a main charge to defeat the primary armor.

However, the missile is confined to defeating relatively large, just such large, heavy and slow-moving targets such as tanks, which are provided with active armor.

The front part of the missile is designed for controlled and systematic opening, the leading projectiles continuing towards the target at a certain velocity, whilst the rear main charge is first braked by a braking force and then re-propelled in order to thereby strike the target later than the leading projectiles.

DISCLOSURE OF INVENTION

An object of the present invention relates to the problem of producing a more versatile warhead.

This object is achieved by a warhead comprising a first and a second part, the parts being arranged relative to one another along a longitudinal axis, the first part comprising a first explosive section, a casing, and a plurality of projectiles enclosed in the casing, and the second part comprising an element designed to control the working of the warhead as a function of a control signal.

The second part advantageously comprises a second explosive section.

The control element is advantageously designed to detonate the first and/or the second explosive section as a function of the control signal.

The fact that the functioning of the warhead can be controlled means that the warhead can defeat a plurality of different targets, which makes the warhead versatile.

The warhead is primarily intended to defeat cruise missiles, signal-seeking missiles, controlled glide bombs and large aircraft. It should nevertheless be apparent that surface targets, such as various types of motorized vehicles. The proposed warhead can naturally also be used to defeat naval targets.

The warhead is capable of defeating both hard and soft small targets. The warhead is capable of defeating both hard and soft large targets. One example of a small, hard target is a glide bomb. One example of a large, soft target is a transport plane. Selected targets can be effectively defeated since the warhead according to one embodiment comprises multiple explosive charges, which can be used selectively in different variations. The explosive sections can advantageously be detonated at different times, independently of one another.

The warhead comprises a plurality of projectiles, the impact energy of which on the target can be selected, since its impact velocity can be controlled according to the invention.

MODE(S) FOR CARRYING OUT THE INVENTION

Figure 1:
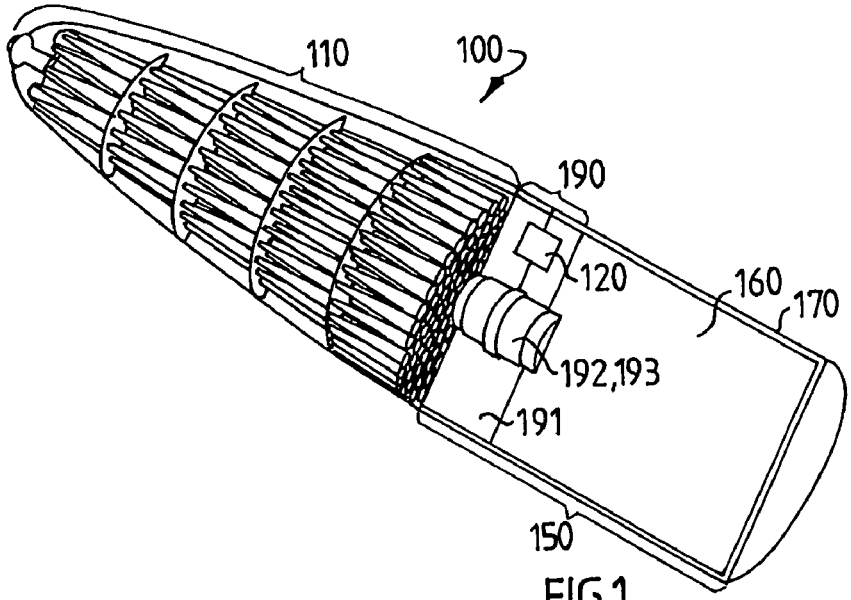
FIG. 1 shows a schematic view of a warhead according to one embodiment of the invention.

FIG. 1 shows a schematic view of a warhead. 100 according to one embodiment of the invention. The warhead as described here comprises three sections. A first section 110 is a main portion. The first section may also be termed a first module. A second section 150 comprises an explosive charge 160 enclosed by a casing 170. The second section may also be termed a second module. A third section 190 comprises, among other things, a detonation-preventing barrier 191 between the first and second section. The third section 190 comprises, among other things, a control element 120 for controlling the detonation, and a booster 192 and priming device 193. The third section is incorporated into the second module.

According to one embodiment the total weight of the warhead is in the range from 1 to 5 kg. The total weight of the warhead is preferably in the range from 3 to 4 kg. According to one embodiment the total weight of the warhead is in the range from 5 to 10 kg. According to one embodiment the total weight of the warhead is in the range from 10 to 50 kg.

The first, second and third sections will be described in more detail below.

The warhead 100 is designed for use in a number of different situations. If the warhead is incorporated into a missile, different types of target can therefore be defeated. According to some embodiments of the invention the first module 110 is thus made in such a way that it will be capable of withstanding the penetration of a target but is also easily capable of opening before striking a target. The opening before striking a target may occur at a distance of 30 meters from the target. Alternatively, opening may occur at a lesser or greater distance from the target. Opening can occur in a controlled manner. Target selection and the mode of action can be upgraded in flight. Target selection and the mode of action can be upgraded automatically in flight. Target selection and the mode of action can be upgraded from a combat control station (not shown) or other authorized user, who is on the ground, for example, relatively close to the target.

The warhead comprises a computer device 120, which is designed to control various processes in the warhead, such as detonation and target selection. The computer device 120 can be preprogrammed. Computer device is another term for a control unit.

The computer device is designed for communication with a combat control station or other authorized user. The warhead can furthermore be equipped with a sensor system (not shown). The sensor system is designed for communication with the computer device. One advantage of the invention lies precisely in the fact that the computer device can be preprogrammed with regard to target selection and desired effect, since the sensor system might be subject to interference from external sources, which can result in a greater uncertainty factor. Using a simple command device, a combat control can therefore modify the target selection and/or desired effect at a late stage in a firing procedure or, as stated, even in flight. In practice the warhead is therefore effective against many different types of target.

Figure 2A:
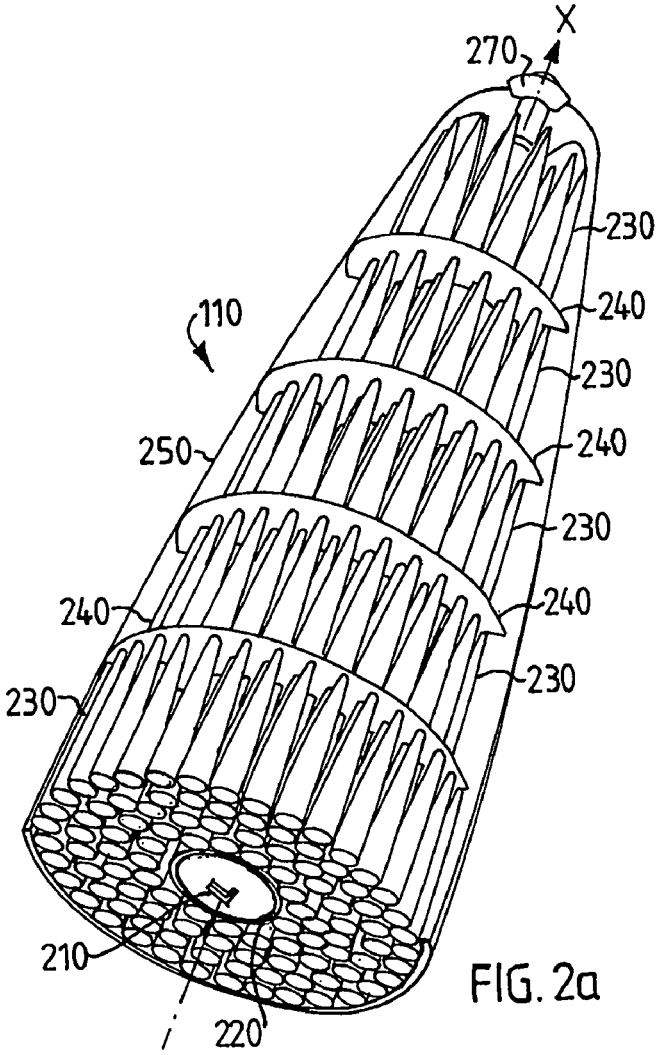
FIG. 2*a* shows a schematic, perspective view of a main portion according to one embodiment of the invention.

FIG. 2*a* shows a main portion according to one embodiment of the invention. The main portion is for the most part rotationally symmetrical about a longitudinal axis x as shown in the drawing. The X-axis is the central axis of the warhead. The main portion comprises an explosive column 210, which extends along its longitudinal axis and is tightly housed in a sabot 220. Alternatively, there may be plastic or air between the explosive column 210 and the sabot 220. The explosive column 210 is therefore centrally located in the main portion. The explosive column 210 and the sabot 220 are rotationally symmetrical about the x-axis.

The main portion contains aimed projectiles 230 in a number of layers as shown in the drawing. There may be just one layer. According to one aspect of the invention the main portion comprises five layers of projectiles 230. The various layers of projectiles are separated by support rings 240. Should there be five layers of projectiles, there are four support rings arranged in the main portion. The support rings are advantageously made of a light metal, such as aluminum or aluminum alloy. Alternatively the support rings may be made of plastics or rubber. The support rings are designed in such a way that they lend stability to the main portion. In particular, the support rings lend stability to the main portion in flight and particularly on impact with a target. According to one embodiment the support rings are securely attached to the sabot 220. The support rings are therefore circular disks each having a hole therein. According to another embodiment the support rings are tightly joined to the sabot. According to yet another embodiment one or more support rings are firmly attached to the sabot whilst one or more support rings are tightly joined to the sabot The main portion is enclosed by an outer shell 250. The outer shell may also be called the casing. The casing 250 is axially segmented in its longitudinal direction. The outer shell may comprise 10 segments 260. According to another embodiment the outer shell comprises 15 segments, but the number of segments may range from 2 to 50. Alternatively the number of segments is greater than 50. Another term for segment used in the description is module. A first end of each segment is detachably fixed to the second module 150. A second end of each segment is fixed to a locking sleeve 270 located at the second end of the main portion, that is to say in the front section of the main portion, as shown in the drawing. The segmented casing is therefore held together by, among other things, the locking sleeve 270 at the second end of the main portion. Alternatively another fastener may be used. According to one embodiment the locking sleeve is released by the pressure effect caused by detonation of the explosive column 210. The pressure may be caused, among other things, by expanding explosive gases. According to an alternative embodiment a mechanical rod or spring may be used to release the locking sleeve. The mechanical spring may be controlled electromechanically by the computer device 120. The mechanical rod may be controlled by means of a pyrotechnic charge (not shown ). Once the locking sleeve has been released, the casing can be opened by the pressure of the explosive column. After initial opening the effect of ambient air can also contribute to further opening in flight. The shell is easily opened and projectiles present in the main portion can be dispersed in a predefined manner. It should be clearly apparent that the casing is designed so that it can withstand high external pressure, especially on penetrating a target, but can at the same time readily disintegrate when one or more of the casing modules is exposed to a certain internal pressure, particularly when the explosive column is detonated.

In their outer section the support rings 240 are each tightly housed in a respective groove arranged in the shell segments 260. The support rings may be composed of aluminum. The support rings may be entirely or partially enclosed in epoxy resin, plastic foam or rubber or they may be surface-treated. Each shell segment therefore has at least one groove for each support ring. In a position in which all axial segments enclose the first module, and the locking sleeve is furthermore locked, all support rings are incorporated into the respective grooves of all shell segments on different levels. One of the functions of the support rings is that they exercise a stabilizing effect on the effect part or the entire warhead when it penetrates a target, for example an aircraft fuselage, since they enter at an angle other than a right angle, that is to say obliquely in relation to the direction of flight.

Figure 2B:
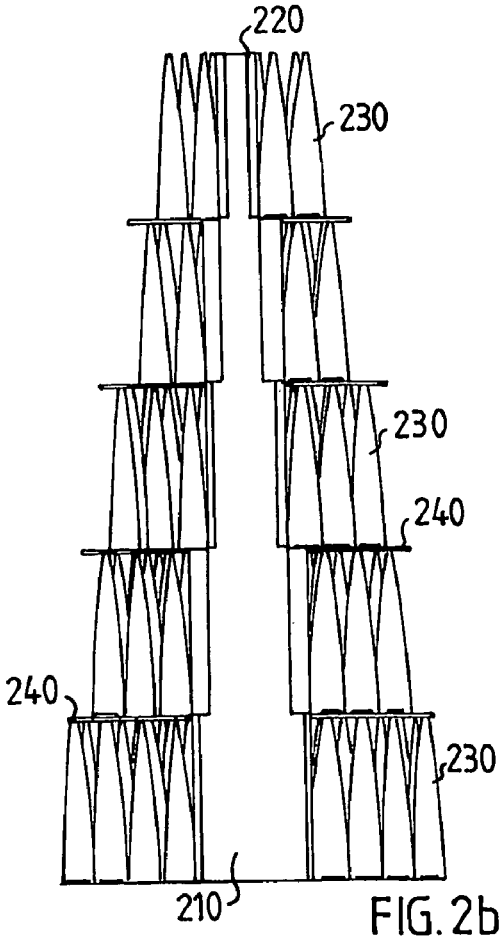
FIG. 2*b* shows a schematic, cross-sectional view of a main portion according to one embodiment of the invention.

FIG. 2*b* shows a schematic, cross-sectional view of a part of a main portion according to one embodiment of the invention.

Figure 3:
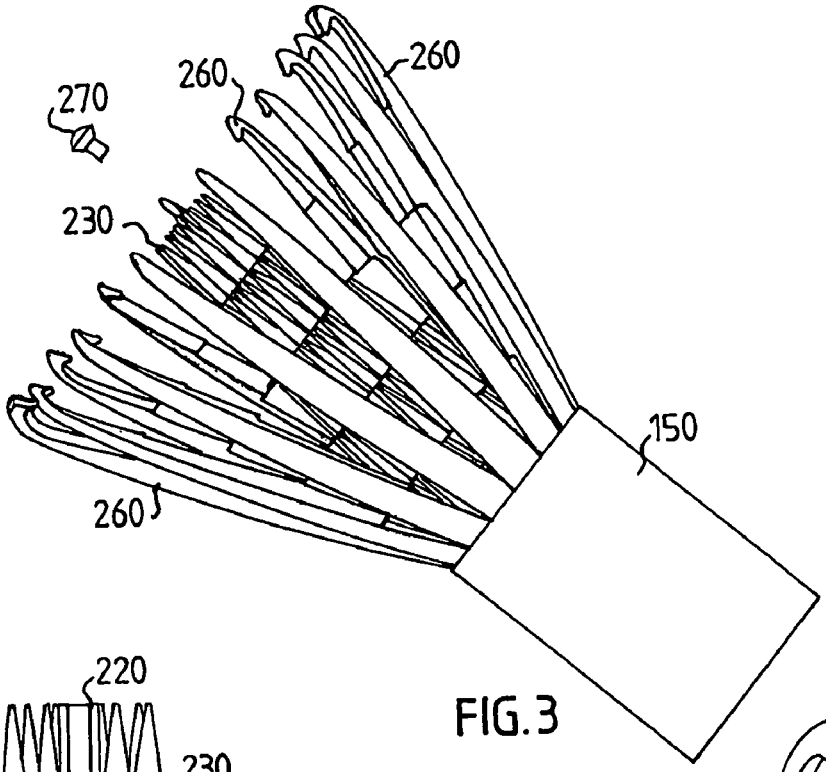
FIG. 3 shows a schematic view of a casing on a warhead in a half-opened position according to one embodiment of the invention.

FIG. 3 shows a schematic view of the main portion described with reference to FIG. 2*a* in a half-opened position. The segments can be released largely at right angles to the direction of flight. According to one embodiment a rotational movement occurs about the respective point at which each segment is fixed to the second module.

Figure 4:
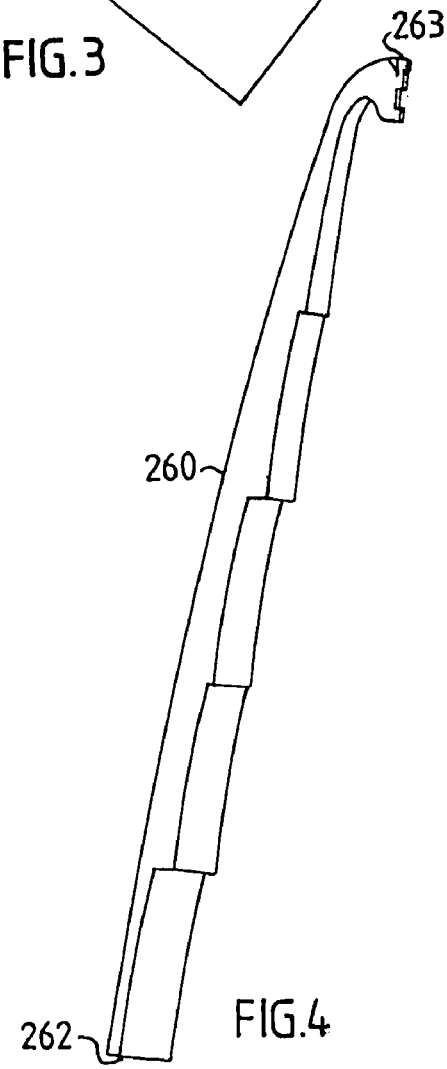
FIG. 4 shows a schematic view of a segment of the casing according to one embodiment of the invention.

FIG. 4 shows a schematic view of an axial shell segment according to one embodiment of the invention. The shell segment is accordingly a part of the outer shell of the main portion. The shell segment is an elongate, curved profile. At a first end 262 the shell segment is fixed to the second module.

A first side of the shell segment is essentially smooth. The first side of the shell segment is an outer side of the shell part. A second side, which is the opposite side to the first side, has a broken structure designed to be capable of receiving support rings as described above. At its second end 263 the shell segment is formed in such a way that it can be fixed to the locking sleeve.

The casing may be composed of aluminum, steel, carbon fiber-reinforced material, glass fiber reinforced epoxy resin or plastic, to name but a few materials.

Figure 5:
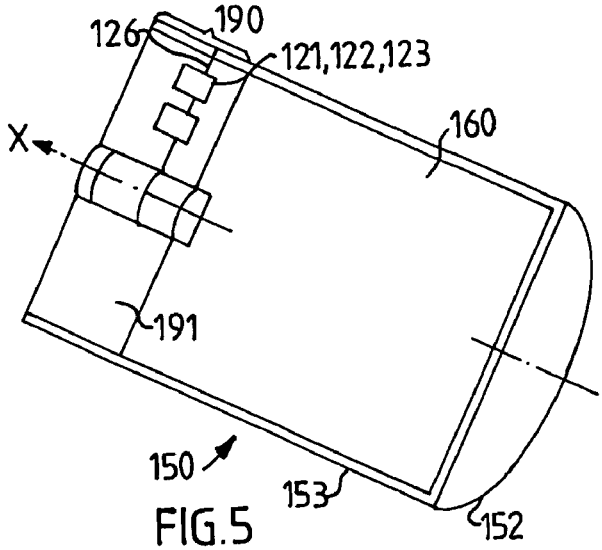
FIG. 5 shows a schematic view of a second module according to one embodiment of the invention.

FIG. 5 shows a schematic view of the second module according to one embodiment of the invention. The second module is rotationally symmetrical about the x-axis. The second module contains explosive 160, such as PBX 80/20, for example, or a thermobaric charge. The explosive is surrounded by an outer casing. The casing is preferably composed of a metal or light metal. The casing may be composed of steel. At a first end the second module has a rear cover 152. The rear cover constitutes a section of a casing which encloses the second module. The rear cover may be composed of a different material to the remainder of the casing.

The third section 190 is situated at a second end of the second module. The explosive is therefore situated between the rear cover 152 and the third section 190. The third section contains electronics for controlling the priming device and processing control signals received from external devices. The third section also serves as or contains a detonation-preventing barrier 191. The barrier is designed to prevent the accidental or intentional detonation of explosive in the first or the second module when they are to detonate separately or at different times. If, according to one exemplary embodiment, for example, the explosive present in the second module is detonated first, the explosive column in the first module must not be detonated. The barrier is preferably composed of a combination of different materials, so that it is capable of absorbing a large proportion of the any pressure wave generated.

According to one embodiment the second module has been equipped with a device capable of producing a directed explosive effect (RSV).

When assembling the warhead, additional material may be provided in order to reduce the detonation-transmitting effect. The additional material may consist of material having different acoustic characteristics to the remainder of the barrier. According to one embodiment the warhead may therefore be tailored to the function of the detonation-preventing barrier.

One advantage of the second module is that it is capable of producing an accelerating movement of the first module upon detonation. Detonation of the second module therefore boosts the speed of the front module in the direction of movement of the warhead. The boost may be desirable in certain situations such as when engaging a receding target or in cases where a higher speed of the warhead projectiles before they strike the target is desirable. The boost may be in the range from 1 to 500 m/s. The boost is preferably in the range 200-400 m/s.

A control unit 120 is arranged in the second module. The control unit is coupled to a first communications terminal 121. The communications terminal contains a first receiver 122 and a first transmitter 123, which are designed to communicate with an external second communications terminal 124 (not shown). The second communications terminal may be located in a missile 1600, in which the war head is transported. The second communications terminal 124 may be located on the ground and controlled from a combat control station. Before firing from a missile containing the warhead, therefore, a combat control station can transmit information on, among other things, target selection and how the warhead is to be used. This information can be communicated via the missile or directly to the warhead. The information can also be transmitted from the combat control to the warhead in flight, that is to say when the warhead is on its way to a target. Communication can be achieved by means of a guide beam or a coded electrical signal. According to one embodiment the communications terminals are designed for wireless communication with one another. According to one embodiment the communications terminals are designed to communicate with one another by way of a line or data bus 126. According to one embodiment the second module contains two control units. The two control units may be largely similar to one another. The two control units may each control a detonation of the explosive column or the explosive charge in the second module.

The control unit may be preprogrammed. The control unit may contain a library of information on targets and different scenarios. The library may be used when the control unit performs an automatic target evaluation. Further information can be supplied to the control by means of target sensors (not shown).

Priming of the explosive column and/or the explosive 160 in the second module can be initiated by a booster 192 known in the art. Priming can be achieved by means of a detonator 193, EBW (exploding bridge wire) or EFI. The priming process is preferably controlled by the control unit 120.

Figure 6A:
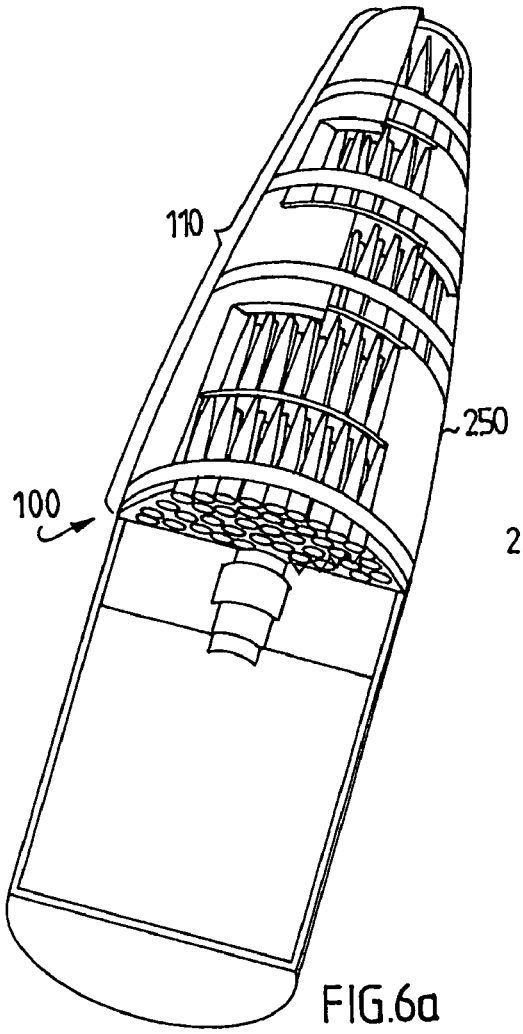
FIG. 6*a* shows a schematic view of a warhead according to one embodiment of the invention.

FIG. 6*a* shows a schematic view of a warhead 100, comprising a main portion 110 with segmented shell 250 and an explosive column 210 according to one embodiment of the invention.

According to one embodiment of the second principle the total weight of the warhead is in the range from 1 to 5 kg. The total weight of the warhead is preferably in the range from 3 to 4 kg. According to one embodiment the totals weight of the warhead is in the range from 5 to 10 kg. According to one embodiment the total weight of the warhead is in the range from 10 to 50 kg.

The enclosing shell comprises a plurality of segments 251. The number of segments may vary depending on which design construction is adopted. The number of segments may be 2 to 4. The segments are designed to latch in one another and to be held in a specific position by means of a band 254. The segments may advantageously overlap one another in order to afford greater stability. The segments may be composed of glass fiber-reinforced epoxy resin or a light metal, such as aluminum. According to one embodiment the enclosing shell comprises 16 segments distributed in four layers in an axial direction. Each layer comprises four segments. Each layer comprises segments of the same size as one another. Two adjacent segment layers have a reciprocal angular offset with regard to the segment joints in each segment layer. The angular offset may be 45°, for example. The segments are fitted with an angular offset so that their joints will not be aligned. This serves to improve the flight characteristics of the warhead. It furthermore provides a cap which is more stable on penetrating a target.

A band is preferably arranged around each segment layer. Each band is made of a material which is strong enough to hold each series of segments together in flight. The bands are furthermore intended to break easily and to allow release of the segments on detonation of the explosive column.

Means for causing the bands to break may be arranged on the warhead. For example, an edge may be arranged so that each band is cut on impact with a target.

Alternatively, means controlled by the control unit are designed to cut each band as a function of a control signal received.

An inner side of each segment is advantageously formed so that the projectiles are well-fitted into the surrounding casing. The outer projectiles in each projectile layer must therefore be tightly housed in the casing.

Figure 6B:
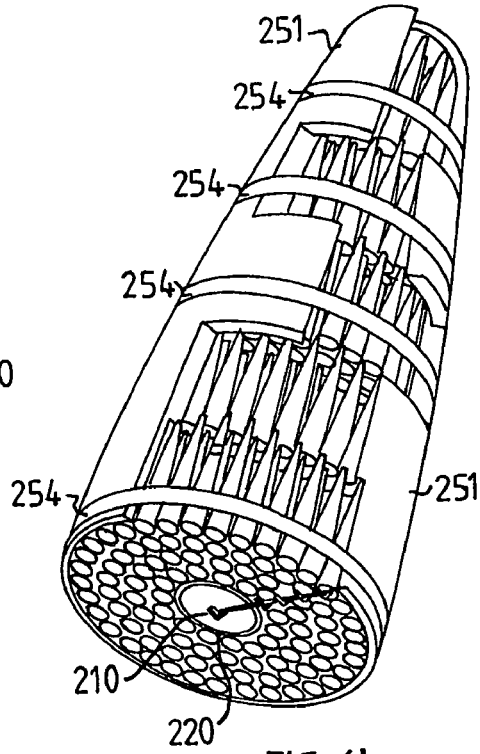
FIG. 6*b* shows a schematic view of a main portion according to one embodiment of the invention.

FIG. 6*b* shows a more detailed schematic view of a main portion according to one embodiment of the invention.

Figure 7A:
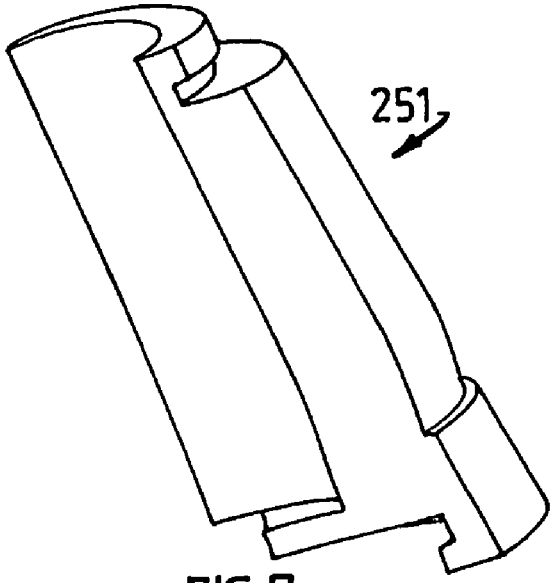
FIG. 7*a* shows a schematic view of a segment of a casing of a warhead according to one embodiment of the invention.

FIG. 7*a* shows a more detailed schematic view of a shell segment according to one embodiment of the invention. The shell segment is provided with two grooves intended for latching to segments of one or more adjacent layers in order to form a casing which covers the first module. The shell segment may also be provided with grooves in a second dimension for latching to adjoining shell segments.

Figure 7B:
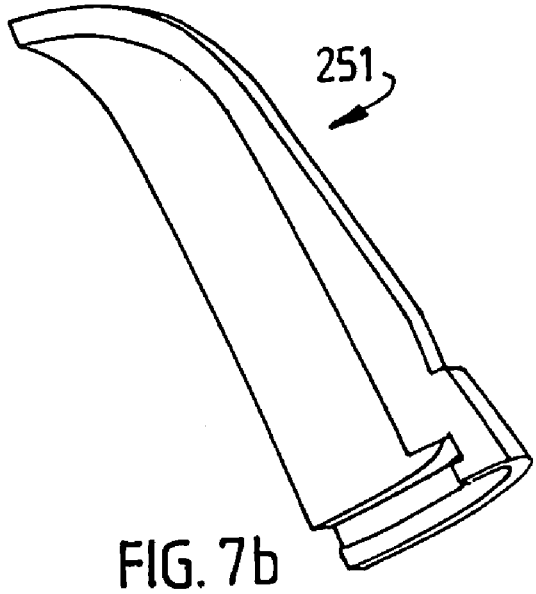
FIG. 7*b* shows a schematic view of a segment of a casing located on a front part of a warhead according to one embodiment of the invention.

FIG. 7*b* shows a schematic view of a shell segment which is located at the second end of the main portion. The shell segment has only one groove in a first end, as can be seen from the drawing. According to this principle also, the segments in a layer at the second end of the effective part may be fixed by a locking sleeve as described above and may have grooves for latching to adjoining segments.

Figure 8:
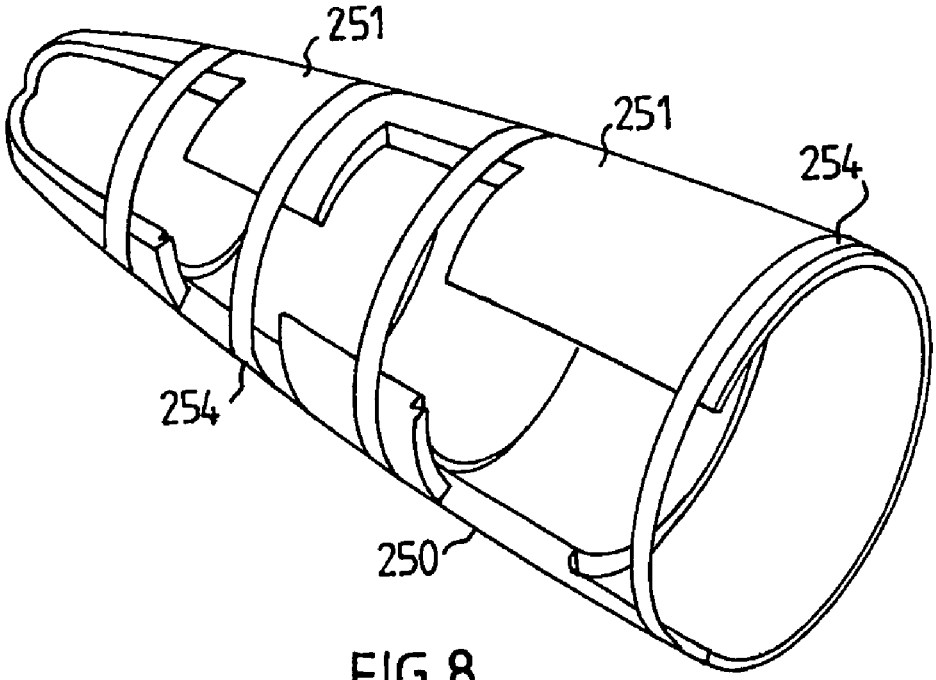
FIG. 8 shows a more detailed schematic view of a segmented casing according to one embodiment of the invention.

FIG. 8 shows a more detailed schematic view of a segmented shell according to one embodiment of the invention. The segmented shell according to the second principle allows penetration of a 5 mm Dural target with the effect substantially maintained.

Figure 9:
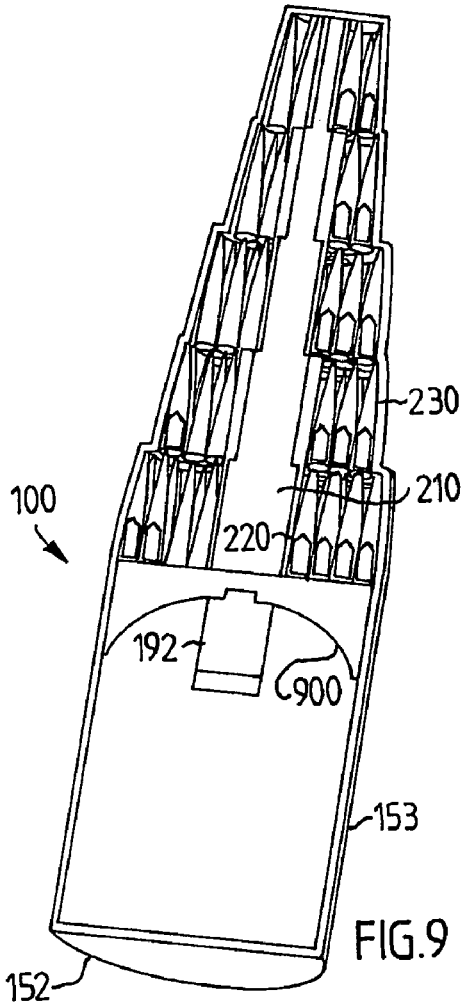
FIG. 9 shows a schematic view of a warhead according to one embodiment of the invention.

FIG. 9 shows a schematic view of a warhead 100 according to one embodiment of the invention. The warhead has been designed to withstand penetration of a target in that a second module has a pressure end 900. This applies even if the target has a Dural shell. The warhead 100 has a casing of a different type to the shells described above. The shell has a primarily cohesive function. The shell has a weight-saving function. The primary characteristic of the shell is that it will hold the first module together until detonation of the explosive column occurs. The shell may be made of plastic or aluminum. The shell may be relatively thin. Instead the head on the second module has the capacity to penetrate a larger target. The warhead here does not have any supporting rings.

Figure 10:
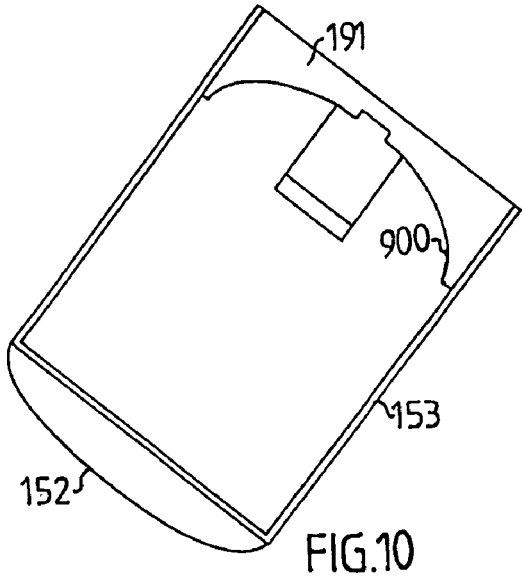
FIG. 10 shows a schematic view of a second module according to one embodiment of the invention.

FIG. 10 shows a schematic view of a second module provided with a pressure end according to one embodiment of the invention. The pressure end is designed for penetration of a target.

Figure 11A:
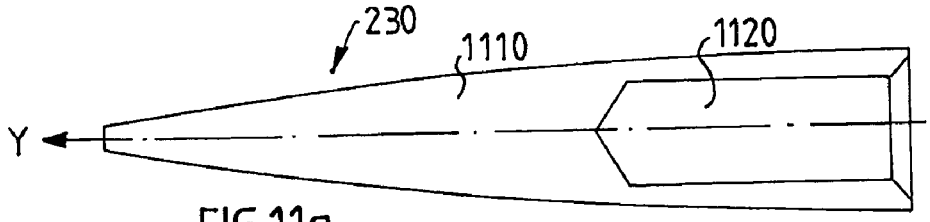
FIG. 11*a* shows a schematic view of a projectile according to one embodiment of the invention.

FIG. 11*a* shows a schematic view of a projectile 230 according to one embodiment of the invention. The projectile is rotationally symmetrical about its longitudinal axis y. The projectile is circular cylindrical with a shape tapering from a first end towards a second end, as can be seen from the drawing. The projectile is composed of a first material 1110. The first material is heavy metal. Heavy metal is an alloy and may contain tungsten, iron, nickel and cobalt. The heavy metal may have a density in the order of 17-18 g/mm$^3$. The projectile is also composed of a second material 1120. The second material is surrounded by the first material. The second material is largely located close to the first end of the projectile. The second material is a metal which is capable of burning, such as Zr, Ti, Mg etc. or a pyrotechnic mixture, such as a tracer mixture, for example. The second material is the material which provides the incendiary effect. The second material is preferably ignited by the detonation of the explosive column. According to a second embodiment the second material of the projectile is ignited by means of an ignition mechanism (not shown). According to a third embodiment the second material of the projectile is ignited by impact energy generated on striking a target or the like. According to a fourth embodiment the second material of the projectile is ignited by an applied retardant. According to a fifth embodiment the second material of the projectile is ignited by a combination of two or more of said embodiments.

According to one embodiment the projectile is 30 mm in length. According to one embodiment the projectile has a diameter which is 6 mm at its first end.

According to one embodiment the projectile is composed solely of a first material and the second material that provides the incendiary effect is thereby omitted.

Figure 11B:
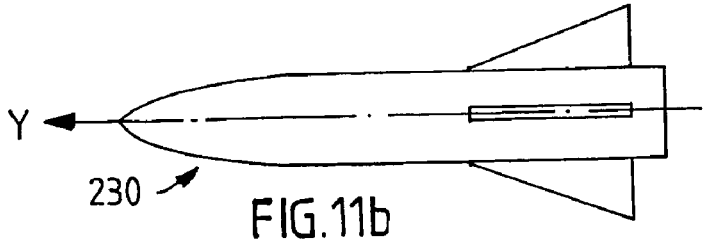
FIG. 11*b* shows a schematic view of a projectile according to one embodiment of the invention.

FIG. 11*b* shows a schematic view of a projectile 230 according to one embodiment of the invention. The projectile according to this embodiment is largely the same as that described with reference t o FIG. 11*a* with the additional feature that the projectile is provided with control fins.

According to one embodiment there are four control fins located close to the first end of the projectile at an angle of 90° to one another. According to a variant there are three control fins at an angle of 120° to one another. The control fins may be composed of a strong, light material, such as aluminum or an aluminum alloy, or alternatively steel or heavy metal.

Figure 11C:
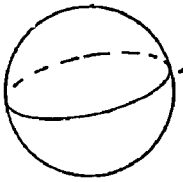
FIG. 11*c* shows a schematic view of a projectile according to one embodiment of the invention.

FIG. 11*c* shows a schematic view of a projectile 230 according to one embodiment of the invention. According to this embodiment the projectile is spherical. In accordance with the aforementioned, the projectile is made from the first material. The projectile 230 may also have a core of the second material and it therefore has an incendiary effect.

Figure 12:
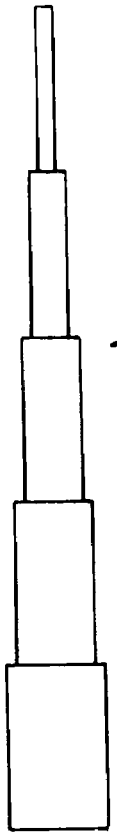
FIG. 12 shows a schematic view of an explosive column according to one embodiment of the invention.

FIG. 12 shows a schematic view of an explosive column 210 according to one embodiment of the invention. The explosive column is centrally located in the main portion. The explosive column is preferably made in one piece. The explosive may consist of PBX 80/20, octol, hexotol or the like. The explosive column comprises circular cylindrical sections. The length of each of the sections is equal to the length of the various layers of projectiles surrounding them, with any transitional zones. The length of each of the sections largely is largely equal to the distance between corresponding support rings. The explosive column is dimensioned in such a way that on explosion it causes the projectiles to disperse in a substantially annular pattern in a radial direction. A detonation of the explosive column therefore means that after a certain time the projectiles form a cluster of projectiles dispersed in one spatial plane. The depth dispersion, that is to say in the direction of flight, may be regarded as negligible. A dispersion pattern is illustrated in more detail with reference to FIG. 14.

The explosive column is furthermore dimensioned so that it has a smaller quantity of explosive where the projectiles have a smaller mass relatively to the rest of their body, that is to at their respective front pointed ends, in order to achieve a more balanced dispersal of the projectiles on detonation.

The explosive column may be divided into a number of independent layers, which can be detonated independently of one another. The various layers each have separate priming devices.

Figure 13A:
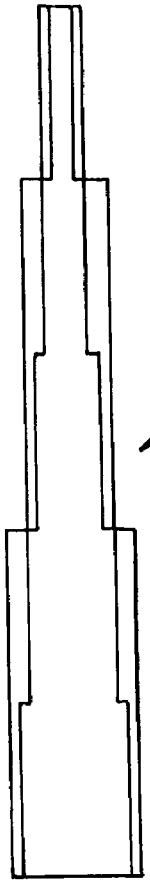
FIG. 13*a* shows a schematic view of a sabot according to one embodiment of the invention.

FIG. 13*a* shows a schematic view of a sabot 220 according to one embodiment of the invention. The sabot may be made from a light metal, such as aluminum or aluminum alloy. The explosive column is tightly housed in the sabot. According to one embodiment the sabot is formed around the explosive column in one manufacturing process. According to another embodiment explosive is fed into the sabot. The sabot may be 1 mm thick.

One function of the sabot is to prevent uncontrolled dispersion of explosive gases between the projectiles upon detonation of the explosive column. The sabot is therefore intended to retain the explosive column in a specific position and improve the projectile ejection process.

Figure 13B:
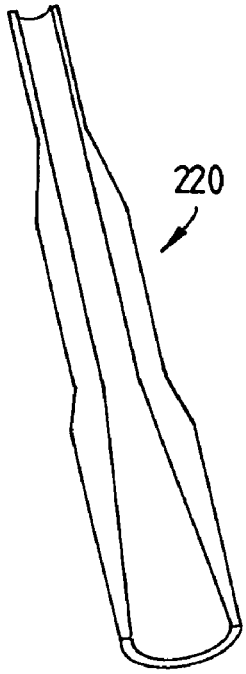
FIG. 13*b* shows a schematic view of a sabot according to one embodiment of the invention.

FIG. 13*b* shows a schematic view of a sabot 230 according to one embodiment of the invention.

Figure 13C:
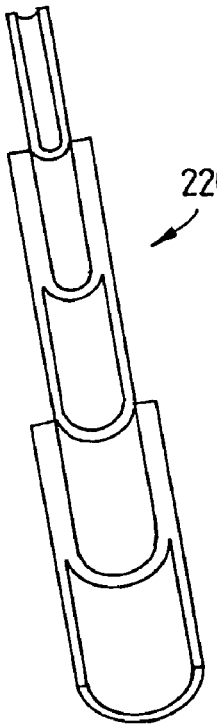
FIG. 13*c* shows a schematic view of a sabot according to one embodiment of the invention.

FIG. 13*c* shows a schematic view of a sabot 230 according to one embodiment of the invention.

Figure 14:
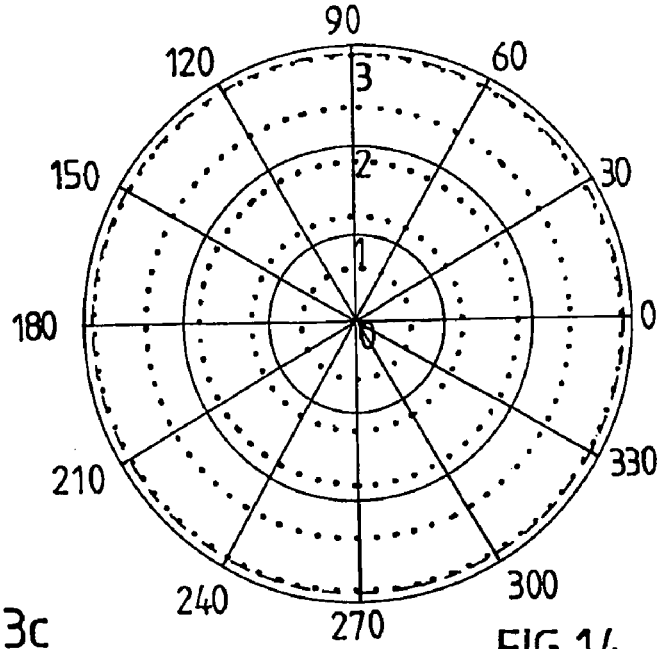
FIG. 14 shows a schematic representation of a dispersal pattern of projectiles according to one embodiment of the invention.

FIG. 14 shows a schematic representation of a two-dimensional dispersal pattern for projectiles according to one embodiment of the invention.

The explosive column is dimensioned in such a way that after detonation the projectiles will be dispersed in a controlled manner in a radial direction. The x-axis of the warhead is therefore aligned on a center point 0 in the figure. The projectiles are preferably dispersed in an annular pattern in a radial direction to the x axis (direction of flight of the warhead). The dispersal varies as a function, for example, of the quantity of explosive and the type of explosive present in the explosive column in each projectile layer, the flechette density in each layer, and the individual mass and design of the flechettes. The projectiles are preferably dispersed in such a way that the respective rings of projectiles are largely equidistant from one another at the calculated time of impact against an intended target. According to one variant the projectiles are dispersed in such a way that they form a three-dimensional cone.

Figure 15:
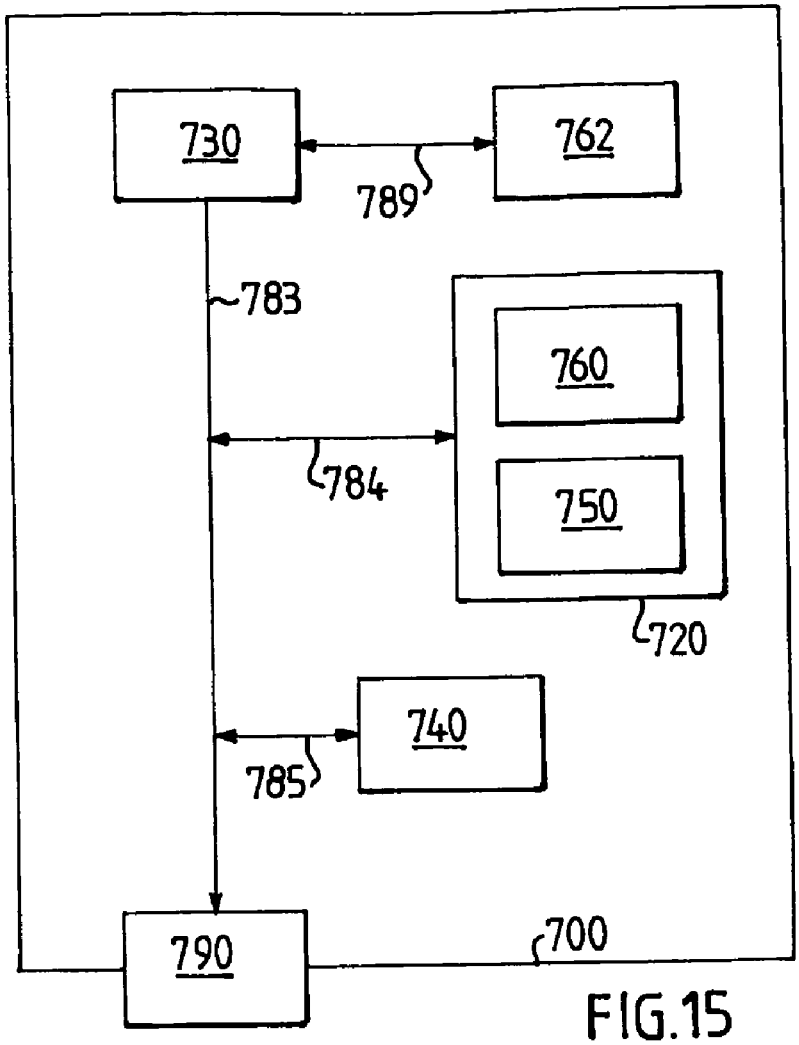
FIG. 15 shows a schematic view of an apparatus that is used according to one embodiment of the invention.

FIG. 15 shows a schematic view of an apparatus according to one aspect of the invention, comprising a non-volatile memory 720, a processor 730 and a read write memory 740. The memory 720 has a first memory part 750, in which is stored a computer program for controlling the apparatus 700. The computer program in the memory part 750 for controlling the apparatus 700 may be an operating system. The apparatus 700 may be enclosed, for example, in a control unit, such as the control unit 120.

The memory 720 also has a second memory part 760, in which is stored a program for controlling the functioning of the warhead 100. In an alternative embodiment the program for controlling the warhead 100 is stored on a separate non-volatile data storage medium 762, such as a replaceable semiconductor memory. The program may be stored in an executable form or in a compressed state.

Where the data-processing unit 730 is described below as running a special function, it should be clearly understood that the data-processing 730 runs a special part of the program that is stored in the memory 720 or a special part of the program that is stored in the non-volatile recording medium 762.

The data processing unit 730 is adapted for communication with the memory 720 by means of a data bus 784 and 783. The data processing unit 730 is also adapted for communication with the memory 740 by means of a data bus 785 and 783. The data processing unit 730 is furthermore adapted for communication with the memory 762 by means of a data bus 789. The data processing unit 730 is also adapted for communication with a data port 799 by means of a data bus 783 The apparatus 700 can communicate with the external, second communications terminal 124 through the data port 799.

Various methods can be performed by the apparatus 700 by running the program which is stored in the memory 720 or the program which is stored in the volatile recording memory 762

Figure 16:
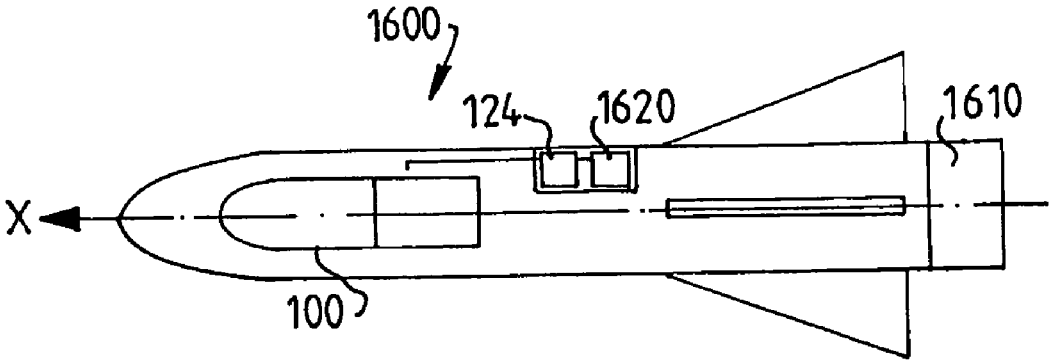
FIG. 16 shows a schematic view of a missile comprising a warhead according to one embodiment of the invention.

FIG. 16 shows a schematic view of a missile 1600 comprising a warhead 100 according to one embodiment of the invention. The missile comprises means 1610 of propelling the missile in a direction of flight. The means of propulsion 1610 may be a jet engine or a propeller, which is driven by an engine. The missile may be designed to release the warhead from the means of propulsion as a function of information regarding a target. The missile can release the warhead by dividing into two or more parts, the parts being separated. Alternatively the missile is designed so that the warhead is released from the missile in a direction of flight, that is to say forwards. This can be done, for example, by launching the warhead. Alternatively, when the explosive column of the warhead detonates, the projectiles can be shot out by the missile in a radial direction to the direction of flight. The information may be supplied by a combat control station either by wireless or via a line. Alternatively, information may be stored in a memory in a control unit 1620 in the missile. Alternatively, information may be stored in a memory 762 in the control unit present in the missile. The control unit 120 in the warhead is designed for communication with the control unit in the missile. The missile can be mounted and fired from aircraft, boats or land-based vehicles, for example.

The missile may be of a fighter type. The missile may be of an attack type.

The invention claimed is:

1. A warhead having a longitudinal axis, comprising:

a first part comprising a first explosive section, a casing, and a plurality of projectiles enclosed in the casing, wherein detonation of the first explosive section results in acceleration of the projectiles in a direction essentially radial to the longitudinal axis; and a second part comprising a second explosive section and a control element configured to control working of the warhead as a function of a control signal, wherein the control element is configured to control detonation and target selection of the warhead and to receive signals permitting modification of at least one of target selection and desired effect of the warhead during firing or in flight, wherein the first part and the second part are arranged relative to each other along the longitudinal axis, wherein the control element is designed to detonate at least one of the first explosive section and the second explosive section as a function of the control signal, and wherein detonation of the second explosive section results in an acceleration of the projectiles in a direction essentially parallel to the longitudinal axis.

2. The warhead according to claim 1, wherein the control element comprises a processor.

3. The warhead according to claim 1, wherein the control element receives the signals from an authorized user.

4. The warhead according to claim 1, wherein the authorized user is a combat control station.

5. The warhead according to claim 1, wherein the control element is configured to control the working of the warhead such that the first explosive section is detonated at a first time and the second explosive section is detonated at a second time.

6. The warhead according to claim 5, wherein the first time and the second time are separated in time.

7. The warhead according to claim 5, wherein the first time occurs prior to the second time.

8. The warhead according to claim 5, wherein the second time occurs prior to the first time.

9. The warhead according to claim 1, wherein the casing comprises at least two segments that are configured to detach from the warhead on detonation of the first explosive section in order to permit dispersal of the projectiles.

10. The warhead according to claim 1, wherein the casing comprises segments elongated essentially parallel to the longitudinal axis.

11. The warhead according to claim 1, wherein the casing comprises a plurality of elongate segments.

12. The warhead according to claim 1, further comprising: at least one band configured to hold the casing in place.

13. The warhead according to claim 11, further comprising:

a fastener configured to hold the elongate segments in place, wherein the fastener is arranged at one end of the first part remote from the second part.

14. The warhead according to claim 11, wherein the elongate segments together form an essentially pointed nose section on one end of the first part remote from the second part.

15. The warhead according to claim 1, wherein the casing comprises a plurality of modules arranged along the longitudinal axis.

16. The warhead according to claim 15, wherein the modules are arranged up against each other and are detachably fixed to each other such that together the modules form the casing, and wherein the modules can readily be released from one another by an increase in pressure in the warhead.

17. The warhead according to claim 1, further comprising:

a detonation-preventing element configured to separate the first explosive section from the second explosive section.

18. The warhead according to claim 1, the control signal is transmitted wirelessly.

19. The warhead according to claim 1, wherein the control signal is transmitted via a line.

20. The warhead according to claim 1, wherein the control element comprises an storage element configured to store information which represents the control signal.

21. A missile, comprising:

a warhead comprising a first part comprising a first explosive section, a casing, and a plurality of projectiles enclosed in the casing, wherein detonation of the first explosive section results in acceleration of the projectiles in a direction essentially radial to the longitudinal axis; and a second part comprising a second explosive section and a control element configured to control working of the warhead as a function of a control signal, wherein the control element is configured to control detonation and target selection of the warhead and to receive signals permitting modification of at least one of target selection and desired effect of the warhead during firing or in flight, wherein the first part and the second part are arranged relative to each other along the longitudinal axis, wherein the control element is designed to detonate at least one of the first explosive section and the second explosive section as a function of the control signal, and wherein detonation of the second explosive section results in an acceleration of the projectiles in a direction essentially parallel to the longitudinal axis; and a propulsion unit configured to propel the missile in a direction of flight.

22. The missile according to claim 21, wherein the missile is configured to release the warhead from the propulsion unit as a function of information on a target.

23. A system, comprising:

a warhead comprising a first part comprising a first explosive section, a casing, and a plurality of projectiles enclosed in the casing, wherein detonation of the first explosive section results in acceleration of the projectiles in a direction essentially radial to the longitudinal axis; and a second part comprising a second explosive section and a control element configured to control working of the warhead as a function of a control signal, wherein the control element is configured to control detonation and target selection of the warhead and to receive signals permitting modification of at least one of target selection and desired effect of the warhead during firing or in flight, wherein the first part and the second part are arranged relative to each other along the longitudinal axis, wherein the control element is designed to detonate at least one of the first explosive section and the second explosive section as a function of the control signal, and wherein detonation of the second explosive section results in an acceleration of the projectiles in a direction essentially parallel to the longitudinal axis; and a central unit configured to generate the control signal that controls the working of the warhead.

24. The system according to claim 23 wherein the central unit comprises a transmitter configured to transmit the control signal, the warhead further comprising:

a receiver configured to receive the control signal.

* * * * *